United States Patent [19]

Kane

[11] Patent Number: 4,735,006

[45] **Date of Patent: * Apr. 5, 1988**

[54] CHANGEABLE SIGN

[75] Inventor: Michael Kane, River Forest, Ill.

[73] Assignee: Kane Graphical Corporation, Chicago, Ill.

[ * ] Notice: The portion of the term of this patent subsequent to Jul. 23, 2002 has been disclaimed.

[21] Appl. No.: 836,017

[22] Filed: Mar. 4, 1986

Related U.S. Application Data

[63] Continuation-in-part of Ser. No. 703,928, Feb. 21, 1985, Pat. No. 4,654,101, which is a continuation-in-part of Ser. No. 648,452, Sep. 6, 1984, Pat. No. 4,530,177, which is a continuation-in-part of Ser. No. 420,044, Sep. 20, 1982, abandoned.

[51] Int. Cl.[4] ..... G09F 7/04

[52] U.S. Cl. ..... 40/621; 40/607; 40/10 R; 40/5

[58] Field of Search ..... 40/618, 5, 607, 621, 40/10

[56] References Cited

U.S. PATENT DOCUMENTS 4,530,177 7/1985 Kane ..... 40/621

*Primary Examiner*—Gene Mancene
*Assistant Examiner*—Wenceslao J. Contreras
*Attorney, Agent, or Firm*—Russell E. Hattis; Lawrence J. Bassuk; Stephen R. Arnold

[57] ABSTRACT

The rear surfaces of sign component pieces carry printed alignment indicating direction indicia in the form of arrowheads that are of a dark color and have a glossy surface luster while the front surfaces of the pieces carry a printed background of the same color but having a flat surface luster. The direction indicia serve to indicate the alignment of the pieces for proper insertion into a changeable sign and for proper shearing from a large sheet during manufacture. The dark color and glossy surface luster reduce eye strain during the shearing of manufacture.

9 Claims, 3 Drawing Sheets

CHANGEABLE SIGN

RELATED APPLICATIONS

This application is a continuation-in-part of copending U.S. application Ser. No. 06/703,928, filed Feb. 21, 1985, now U.S. Pat. No. 4,654,101 which is a continuation-in-part of U.S. application Ser. No. 06/648/452, filed Sept. 6, 1984, now U.S. Pat. No. 4,530,177, which is a continuation-in-part of U.S. application Ser. No. 06/420,044, filed Sept. 20, 1982, abandoned on Sept. 6, 1984. Priority is claimed from all of these applications.

DESCRIPTION

TECHNICAL FIELD OF THE INVENTION

This invention relates generally to changeable signs, such as those used in banks, to identify to the clients of the bank various current investment offerings, the annual interest rates and annual effective yields provided thereby. The broader aspects of the invention apply to other types of changeable signs. The invention further deals with sign component pieces that can be easily placed on a mounting wall surface in intimate contact with other similar pieces so that the entire sign surface appears as a single sheet of material, and yet can be readily easily pulled from the wall surface and be replaced by other similar pieces containing different information.

BACKGROUND OF THE INVENTION

Bank interest signs have been formed from magnetic sheet materials into individual sign component pieces, each forming a numeric digit, that are attached to a metal support surface and adjacent to other similarly attached numeric pieces to form an interest rate number. The B. F. Goodrich Company developed these flexible magnetic sheet materials that can be directly printed upon, or that sometimes carry a pressure sensitive adhesive coating to which a transparent cover sheet is secured. Sign-forming indicia can be printed upon the front of this magnetic sheet material or the rear of the transparent cover sheet.

The bank interest signs, however, left much to be desired from the standpoint of sign attractiveness and flexibility. The only portions of these signs that received the changeable indicia-forming sign component pieces were the interest number sections thereof. The sign component pieces forming the interest number thereof projected from the general plane of the rest of the sign, which contained stationary unchangeable indicia identifying the investment security to which the interest rate number applied, and the position of the stationary indicia limited the positioning choices for the interest rate numerals. Also, because the edges of the individual sign component pieces projecting from the sign were readily visible and accessible, unwanted visitors to the bank commonly grasped the exposed edges of the sign component pieces and rearranged them to the great consternation of the owners of the bank and their regular customers.

A changeable display sign to which the most preferred form of the present invention is applicable comprises a magnet attracting support wall encompassing the area of the desired sign and having on either one or both sides thereof an initially exposed sign component-receiving surface to which individual sign component pieces can be secured preferably by magnetic attraction. The entire exposed area of this magnetic attracting wall surface, which is to contain sign-forming indicia, is covered with thin, flexible sign component pieces preferably having a backing made of the thin, flexible magnetic material. Some of these pieces supply only blank (i.e. preferably background supplying) spaces to the sign and others supply numeric or alphabet characters and the immediate background thereof. When all of the sign component pieces have been applied to the sign-forming support surface, the entire sign viewed from a short distance therefrom appears as a single sheet of material having one continuous printed front surface, even though, in reality, the front surface is made up of different types of individual sign component pieces. The framing of the sign preferably covers the exposed edges of the outermost sign component pieces of the design.

Since the confronting edges of the various sign component pieces are in immediate contiguous relationship, the margins of the individual sign component pieces are barely visible, even to one viewing the sign closely. The thin, flexible sign component pieces to which the invention relates, however, are individually removable, as by use of a suction cup, or by a thin blade removal tool which can be readily wedged between adjacent sign component pieces. To enable this tool to readily peel a corner portion of a sign component piece from the support wall surface, and more importantly, to enable the various pieces to be easily and neatly interfitted into the sign at any point or be removed and replaced thereat by another piece, two of the adjacent and corresponding marginal edges of each piece (i.e. the bottom and right sides) are identically undercut, as by beveling the same, and two of the other adjacent and corresponding edges of each piece (i.e. the left and top sides) are oppositely undercut or are overcut.

The beveling can be readily unexpectedly made with such beveled edges to close tolerances by a shearing scissors cut applied to matrix sheets and strips containing numerous sets of the sign component pieces involved (see FIG. 21 of U.S. Pat. No. 4,530,177) which produces such beveled edges. The bevelling enables the pieces to be readily closely interfitted in precise vertical and horizontal alignment and to be readily separated. This is not practically possible with square cut edges which could not be practically made with small enough tolerances to be easily interfitted or separated if forced tightly together, as they must to present a continuous appearing sign surface. (See German Patent No. 2,847,590 for such a construction).

Where the sign is a bank interest sign, the sign preferably includes row and column header strip pieces having complete wordforming indicia identifying the nature of the sign information contained in various horizontal information bands and vertical column portions thereof. There can also be provided a main header strip piece to be placed at the top of the sign to identify the institution involved and the type of information contained on the sign. These header strip pieces contain information that are rarely changed.

Another type of sign component piece utilized in the bank sign is a relatively narrow piece, containing a numeric digit, decimal point, percent sign, or the like, that is changed or re-positioned frequently. The decimal point piece is the narrowest piece, and the numeric and percent sign pieces are wider and preferably of identical size. Many such pieces are supplied each user for frequent change of interest rate information in the various information bands of the signs. These sign component pieces and associated row header strip pieces preferably extend the identical full height of a standard sized information band of the sign.

There are also provided narrow blank space sign component pieces of at least two different widths to give a choice of indicia separation distances. Blank spacer strips extending a substantial proportion and preferably the full length of an information band are distributed throughout the sign and separate successive information bands of the sign to provide parallel top and bottom edges along which the indicia-containing component pieces are aligned to assure good horizontal alignment of the sign information throughout the sign.

Another type of changeable bank sign component piece preferably provided are relatively narrow and short sign component pieces containing month and day indicia to identify the term of the particular interest rate involved. Such pieces may, for example, be half the height of an information band of the sign and be positioned one above the other so as together occupy the height of a single information band of the sign.

The beveled edges for the several types of component pieces and the distribution of long blank spacer strips achieve near perfect vertical and horizontal alignment of the individual sign component pieces throughout the sign, even though the pieces are not made to a precise size. They are preferably made, however, to tolerances of ±0.005 inch. It is important to achieving this alignment that all of the sign component pieces have matching undercut and overcut adjacent margins and that the undercut and overcut margins are readily identifiable when mounting them on the sign component-receiving surface. Otherwise, the achievement attained by the beveled edges, the near perfect vertical and horizontal alignment, will be frustrated and the edges of the pieces will readily be recognizable. Ascertaining the proper alignment is simple with sign component pieces carrying characters such as "2", "3" and "7" but is difficult for pieces carrying characters such as "0", "6", "9" and the blank pieces.

SUMMARY OF THE INVENTION

In accordance with one aspect of the invention, the proper orientation of at least those sign component pieces which cause orientation problems is ascertained by providing user recognizable direction or orientation indicating indicia on the rear side surface of the backing of the pieces. These direction or orientation indica also serve to indicate the desired directional alignment of matrix sheets and strips from which the sign component pieces are formed, as shown in FIGS. 17, 18, and 19 of said U.S. Pat. No. 4,530,177, when placed in a shearing mechanism to form the undercut and overcut bevels on the correct margins of the sign component pieces. Most advantageously, these indicia comprise arrowheads printed on the rear sides of the pieces.

An unexpected problem with this alignment indicating direction indicia occurred when this indicia is printed on the back of the backing sheet in a light colored ink on the dark color of the backing sheet (or vice versa), resulting in a great contrast beteen the background color provided by the backing sheet and the direction indicia. The method used to cut the various sign component pieces from the matrix sheets and strips requires that the backing direction indicia-containing sides of the sheets and strips from which the pieces are formed be face up. It was determined that while this contrast greatly emphasizes the direction indicia, it caused eye strain in workers spending long hours looking at the matrix sheets and strips from which the individual sign component pieces are cut.

In accordance with another aspect of the invention, the orientation or direction indicating indicia are formed with a color substantially the same as that used for the background color on the rear of the sign component pieces, which has been dark brown, but with a surface finish or luster different from that used with the background color. Thus, the magnet-forming material typically has a flat or semi-gloss luster while the direction indicia has a high gloss luster. This substantially reduces the eye strain on the operator of the shearing device during manufacture of the sign component pieces while retaining the alignment indicating feature of the direction indicia.

Other advantages and features of the invention will become apparent upon making reference to the specification, claims, and drawings to follow.

DESCRIPTION OF THE PREFERRED EMBODIMENT

Figure 1:
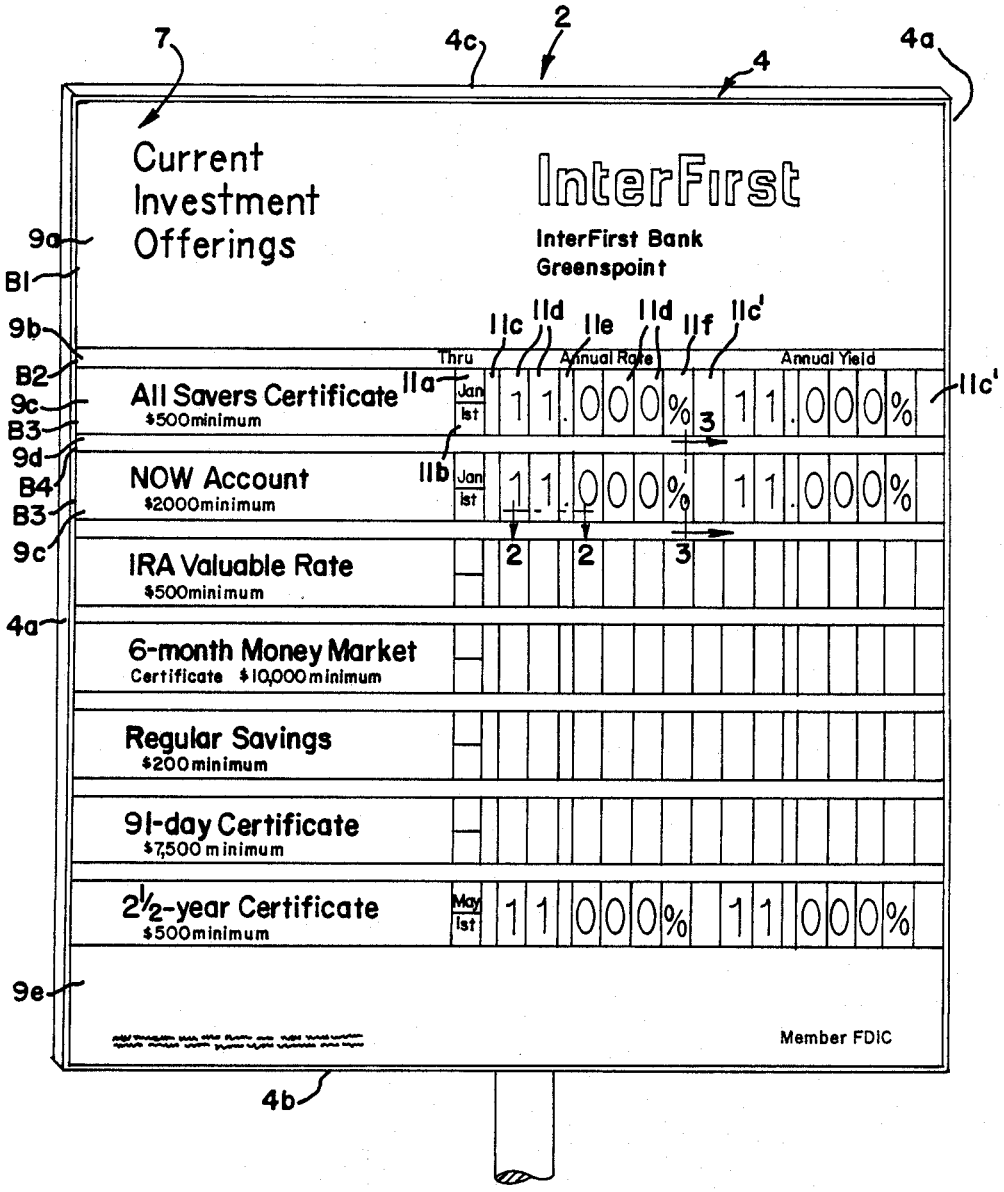
FIG. 1 is an isometric or parallel projection perspective view of a pedestal type sign using indicia component pieces carrying alignment indicating direction indicia of the invention.
Figure 2:
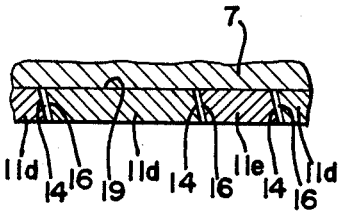
FIG. 2 is a fragmentary sectional view of the sign and sign component pieces taken along the line 2—2 of FIG. 1 in the direction indicated by the arrows.
Figure 3:
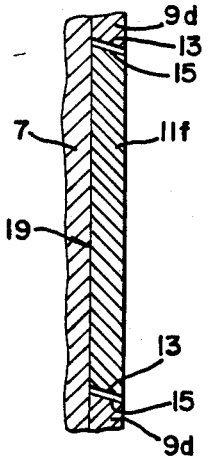
FIG. 3 is a fragmentary sectional view of the sign and sign component pieces taken along the line 3—3 of FIG. 1 in the direction indicated by the arrows.

Referring to FIGS. 1, 2 and 3, there is shown a sign 2 for use in a bank or other savings institution for identifying the different types of investment certificates and the annual rates and annual yields applicable through the stated month and date. The sign includes a support frame 4 which can have any desired construction. Preferably, sign 4 has side strips **4*a*-4*a* connected together at the bottom by a bottom frame strip 4*b* and at the top by a swingable cover strip 4*c*. Strip 4*c*** is pivotable for access to a contained, vertical, metal sign component support wall 7 adapted to carry on one or both faces thereof sign component pieces 9 and 11 formed of narrow pieces or elongated strips to be described, each including a magnetized backing layer which magnetically adheres the same to the support wall 7.

The shapes, constructions, and arrangements of the sign component pieces form a unique sign having one or two sign-forming faces, each of which appears from ordinary viewing distance to have a continuous, flat surface having printed indicia thereon. It should be understood that the sign component pieces 9 and 11 occupy an entire desired sign-forming area on one or both faces of the support wall 7, which area may encompass the entire vertical extent of the face of the support wall involved or a partial portion of the height thereof, in which event the bottom portion of the sign-forming portion of the support wall 7 would be closed by a magnetized metal bar or the like extending along the bottom margin of the bottommost sign component pieces.

In the case of signs for banks identifying the interest rates for various types of investment certificates, the sign 2 generally has a main upper information band B1 identifying the subject matter thereof, namely "Current Investment Offerings" of the bank or other institution involved. This area of the sign is formed by a main header strip 9*a* which, like the other sign component pieces, is a thin, flat, rectangular and flexible piece with a magnetized backing adhering the same to the face of the support wall 7. The side and top margins of the strip 9*a* adjacent to a portion of the frame are preferably covered over thereby so that the edges thereof are not exposed.

The sign 2 also has numerous other horizontally extending information bands or areas containing various kinds of information. Immediately below the main information band B1 is a column information and B2, that can contain the word "Thru" identifying a month and date column of the sign, and the words "Annual Rate" and "Annual Yield" indicia identifying the subject matter of the two vertically aligned columns of numbers appearing in various horizontally extending interest rate bands B3. The column information band B2 can be formed from a single horizontally elongated thin, flexible sign strip 9*a* and other sign component pieces to be described hereafter.

The interest rate bands B3 contain at the left hand portion thereof a region extending only a fraction of the full width of the sign and formed from a row header strip 9*c* which identifies the type of investment offering or certificate involved. To the right of row header strip 9*c* is a pair of vertically spaced month and date indicating sign component pieces 11*a* and 11*b*. These sign component pieces 11*a* and 11*b* are shown as being of identical size, each occupying one half of the height of the interest rate band B3 involved. All of the interest rate bands B3 are shown as having identical height to form a sign of maximum attractiveness and neatness.

Immediately contiguous to the right of the month and date sign component pieces 11*a* and 11*b* is a narrow, blank, spacer-forming sign component piece 11*c*. Each interest rate band B3 has a sign component piece identical to the piece 11*c*. To minimize the number of different size pieces to be used, it is preferred to have two basic types of narrow spacer sign component pieces, namely the narrowest spacer piece 11*c* just described and one twice the width thereof, namely a spacer sign component piece 11*c*′ shown at the end of the interest rate band B3. A similar spacer sign component piece 11*c*′ is placed between the two sets of interest rate information identified previously, in the "Annual Rate" and the "Annual Yield" columns of the sign.

To the right of the narrow spacer sign component piece 11*c* and the next spacer piece 11*c*′ are a series of numeral and decimal sign component pieces, the numeral pieces being identified by reference numeral 11*d* and the decimal sign component piece being identified by reference numeral 11*e*. Finally, each of the interest rate bands B3 of the sign will have a percent sign component piece 11*f* following each multi-digit number in the interest rate and interest yield columns of the sign. Each of the sign component pieces 11*a*, 11*b*, 11*c*, 11*c*′, 11*d*, 11*e*, and 11*f* are individually removable from the sign in a manner to be described.

To minimize the cost of fabrication of the sign component pieces and to simplify the manufacture thereof in a manner to be described, all of the row header strips 9*c* at the beginning of each interest rate band B3 preferably will be of identical width and height and all of the spacer, numeric, decimal point and percentage sign component pieces except the month and date pieces 11*a* and 11*b*, preferably will have identical heights. Except for the decimal sign component pieces 11*e*, which have an identical width to the narrow spacer sign component pieces 11*c*, the other small sign component pieces, namely the numeric, percentage spacer, month and date sign component pieces 11*d*, 11*e*, 11*c*′, 11*a* and 11*b* preferably will have identical widths.

In order to provide a sign which has a maximum information band spacing flexibility, it is most advantageous to distribute through the sign horizontally elongated sign component spacer strips 9*d* each of which extend an appreciable portion preferably the full width of the sign face. In the former case, two or three strips would fill an entire horizontal band. Also, the strips are preferably a fraction of the height of the interest rate bands B3. The strips 9*d* will generally separate the interest rate information bands B3 formed by the row header strips and the small sign component pieces just described. These strips present parallel top and bottom aligning edges for the sign component pieces above and below the same so that good horizontal alignment of the indicia-carrying sign component pieces is achieved.

At the very bottom of the indiciacarrying portion of the sign, there can be provided a horizontally elongated sign component strip 9*e* which can be a blank strip or a strip containing additional information which the bank or other financial institution desires to communicate to its customers.

As previously indicated, each of the sign component pieces described has an identical thickness and construction to be described, which enables the pieces to be placed in immediate contiguous relationship to the adjacent sign component piece to the right, left, above or below the same, so that from a few feet away the front surface of the sign appears to be continuous surface of a printed sheet of material. Also, this construction permits an easy sign change by removing individual pieces with ease and replacing them easily with other similarly sized pieces. A sign of this type could not be made as a practical matter unless the pieces could be economically fabricated to precise toleranceas and related in a manner such that they can be readily peeled one piece at a time from the surface of the support wall 7.

Figure 4:
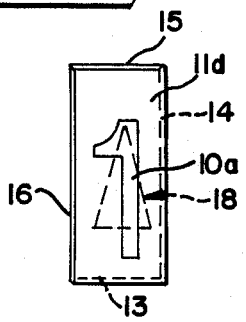
FIG. 4 is a front elevation view of a sign component piece.

Referring to FIGS. 2, 3, and 4 the bottom margins 13 and right margins 14 of all the sign component pieces 9 and 11 are undercut to form beveled margins and the top margins 15 and left margins 16 are overcut to form beveled margins. The confronting overcut top and undercut bottom margins of all the sign component pieces 9 and 11 thus mate with one another in beveled relationship when mounted on the support wall 7. Similarly, the confronting overcut left and undercut right margins of all of the sign component pieces 9 and 11 also mate with one another in beveled relationship when mounted on the support wall 7.

The sign component pieces thus must be properly directed when placed on support wall 7 for the confronting margins properly to mate with one another to achieve the apparent lack of seams between the pieces. Placing one sign component piece in an inverted direction destroys this result and causes the misdirected piece to be markedly visible.

The bevels in actuality are slight and difficult to see and are shown emphasized in the drawing figures for description purposes. The proper direction for placement of the sign component pieces 9 and 11, is indicated by alignment indicating direction indicia 18 in the form of an arrowhead printed on the rear or back surface 19 of each sign component piece 9 and 11. These direction indicia provide at a glance positive indication of the direction in which all pieces are to be aligned on the support wall 7.

Figure 5:
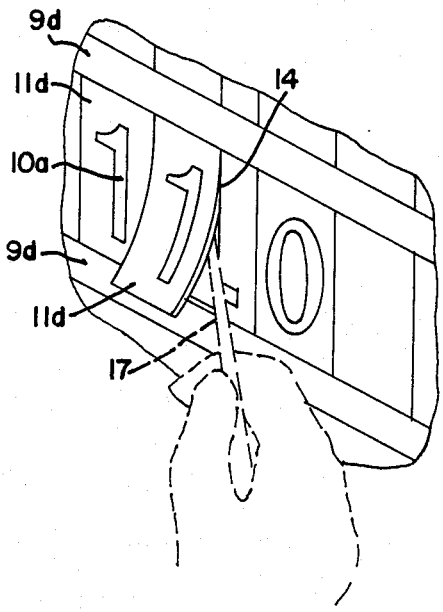
FIG. 5 is a perspective view of execution of a procedure for removing a sign component piece from the sign.

In FIG. 5, an individual sign component piece can be removed from the support wall 7, such as by the use of a suction cup or by a thin blade edge tool 17, shown in phantom lines, pushed into the space between the bevels of sign component pieces 9 and 11. Because of the undercut and overcut shape of the sides of these pieces, preferably formed by beveling the edges thereof in a scissors edge shear cutting operation, the tool can then be twisted to bring the tool blade edge behind the magnetic backing of the piece involved, where a forward pull on the tool flexes the edge portion of the sign component piece forwardly from the support wall.

Figure 6:
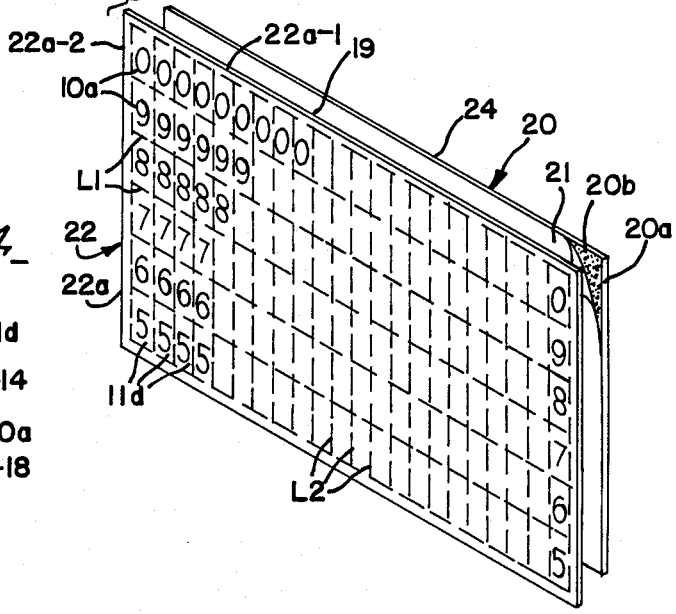
FIG. 6 is an exploded perspective view of a form matrix sheet from which individual sign component pieces are sheared.

Referring to FIG. 6, each of the sign component pieces 9 and 11 are cut from a large form matrix sheet such as letter form matrix sheet 23. Letter form matrix sheet 23 comprises a magnetic backing sheet or layer 20 comprising a main body portion 20*a* advantageously coated with a pressure sensitive adhesive 20*b*. Main body portion 20*a* has a consistency of flexible rubber and can be the product previously referenced manufactured by the B. F. Goodrich Company. Typically, body portion 20*a* can have a thickness of 0.020 inch.

Letter form matrix 23 further comprises a cover sheet or layer 22 having a main translucent body portion 22*a* that can be a 0.010 inch thick polycarbonate sheet or other similar material such as that sold under the name Lexan by the General Electric Company. The main body portion 22*a* carries printed on an inner face 19 thereof a first indicia-forming coating, resulting in the characters 10*a*, and a silk screen printed background color-forming coating thereover. A cover sheet or cover layer 22 of this thickness does not follow the depressions and undulations in the outer surface of the magnetic backing layer 20, as could be the case if the main body portion 22*a* were a fraction of this thickness.

The adhesive 20*b* of the magnetic backing layer sheet 20*a* is covered by a protective sheet 21 that is removed to apply the magnetic backing sheet 20 to the inner face 19 of cover layer sheet 22 and obtain the laminated letter form matrix 23.

The cover layer sheet 22*a* is made to a precise dimension with the top marginal edge 22*a*-1 and the left marginal edge 22*a*-2 as viewed from the front of the sheet beihg reference edges from which the various indicia printed on the sheet is precisely located so that after a trim cut of, for example, $\frac{3}{4}''$ is made, the corresponding top and left margins of the various indicia-containing areas thereof are identically spaced. The backing layer sheet 20*a* of each matrix is somewhat smaller than the associated cover layer sheet 22*a* and is located centered within the margins of the cover layer sheet. The cover layer sheet 22*a* of each matrix preferably is made oversize and, when applied to the shearing devices to be described, is initially trim cut along the lines spaced from the reference edges 22*a*-1 and 22*a*-2 and within the margins of the backing layer sheet 20*a*.

Figure 7:
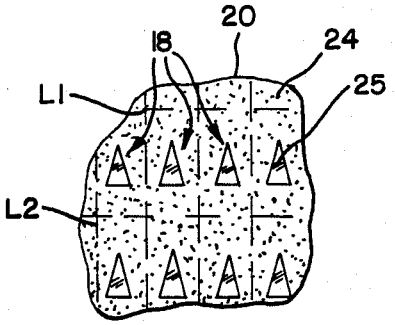
FIG. 7 is a fragmentary plan view of the rear surface of a prior form matrix sheet carrying a first embodiment of printed alignment indicating direction indicia according to the invention.

Referring to FIGS. 6 and 7, the rear surface 24 of magnetic backing sheet 20 has been printed with alignment indicating direction indicia 18 in the form of arrow heads all pointing in one direction, upwardly, towards the top of the drawing FIG. 7. Indicia 18, in a first embodiment, are printed in the form of white ink arrowheads 25 upon the flat surface texture, indicated by stiple shading, of the rear surface 24 of the magnetic backing sheet 20. The white ink printed arrowheads 25 attain a great contrast over the color and texture of rear surface 24 readily to indicate the direction that the form matrix sheet 23 is to be aligned in the shearing device to produce the desired beveled edge undercuts and overcuts on the proper margins of the pieces 9 and 11, and also to indicate the direction that the pieces 9 and 11 are to be inserted onto the support wall 7 in forming the desired informational sign. A drawback is that the contrast attained is too great, and results in eye strain in shearing device operators who have to stare at the white arrowheads 25 for extended periods.

Figure 8:
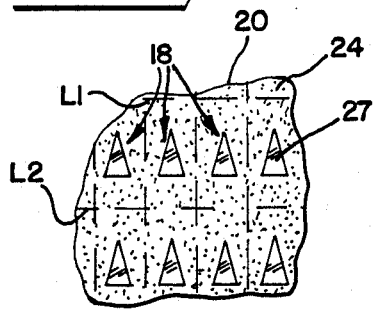
FIG. 8 is a fragmentary plan view of the rear surface of a form matrix sheet carrying a second embodiment of printed alignment indicating direction indicia according to the invention.

Referring to FIG. 8, the alignment indicating direction indicia 18 of the second and preferred form of the invention also are in the form of arrowheads 27, but have much less contrast with the flat textured, stiple shaded surface 24 of the magnetic sheet 20 than occurred with the arrowheads 25. Specifically, indicia 18 are in the form of arrowheads 27 printed on surface 24 with the same color ink that the background color is printed on the inner surface 19 of the cover sheet 22, but having a luster or surface finish that is different from the background color. Thus, preferably the background color is dark brown and has a flat or low gloss luster and the director indicia 27 also is dark brown but has a gloss luster. Particularly, the gloss luster of indicia 27 provides good contrast with the flat surface finish of surface 24 readily to indicate direction without causing eye strain in shearing device operators.

Figure 9:
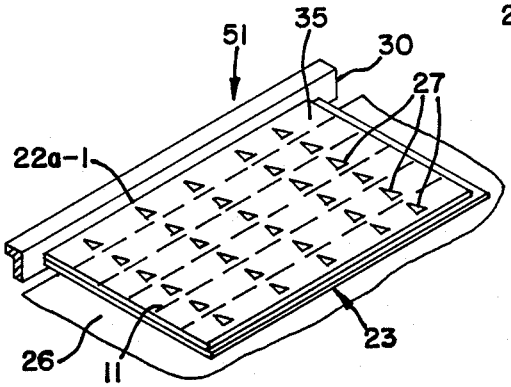
FIG. 9 is a fragmentary perspective view of part of a shearing device loaded with a form matrix sheet carrying direction indicia according to the second embodiment of invention.
Figure 10:
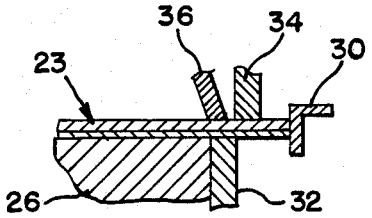
FIG. 10 is a fragmentary median sectional view of a shearing device loaded with the form matrix sheet.
Figure 11:
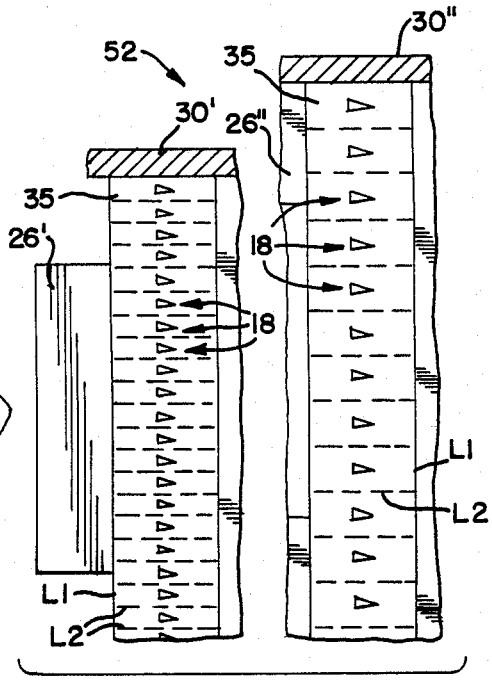
FIG. 11 is a fragmentary plan view of two shearing devices each loaded with a strip sheared from the form matrix sheet.

Referring to FIGS. 9, 10 and 11, sheet 23 is placed on a table 26 of a shearing device S1 with top margin 22*a*-1 against stop 30. A stationary bottom knife 32, having a flat top edge, and an upper movable shearing blade 34, having a flat bottom edge, act like scissors to shear strips 35 of material from the matrix sheet 23 along horizontal cut line L1. Hold down bar 36 prevents movement of the matrix sheet 23 during a shearing cut. Individual sign component pieces 9 and 11 are cut from the strips 35 in similar shearing devices S2 along vertical cut lines L2. It will be understood that the cut lines L1 and L2 need not be printed or actually appear on the rear surface 24 of the magnetic sheet 20 to indicate the lines along which the strips 35 and pieces 9 and 11 are to be cut and appear in the drawing to clarify the disclosure.

Indicia 18 in the form of arrowheads 25 and 27 are used on shearing devices S1 and S2 to indicate the alignment direction of the sheet 23 and strips 35 to form the beveled margins correctly. Referring also to FIGS. 7 and 8, preferably there is at least one indicator 18 on each sign component piece between the cut lines L1 and L2. Alternatively, there can be as many indicia for a piece as are desired.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. A changeable display sign comprising: a support wall for changeable sign components, said support wall having on at least one side thereof an initially exposed sign component-receiving surface; said sign component-receiving surface having removably attached thereto a plurality of thin, flat, rectangular, flexible sign component pieces arranged in close contiguous rows so as to fill an entire sign-forming area of the sign and so that the sign component pieces from a distance appear to form a single sheet sign having one continuous flat surface, each sign component piece having a width less than that of a single row having on two adjacent sides of the piece beveled edges of a given inclination and the other two adjacent sides of the piece having edges oppositely beveled so that adjacent confronting edges of adjacent component pieces above, below and to said side thereof interfit, any sign component piece having the width of a single row having top and bottom edges with the same beveled edges as the top and bottom edges of said sign component pieces having a width less than the length of a row, whereby adjacent edges of the inner fitting sign component pieces have complementary interfitting beveled edges and there is provided orientation indicating indicia on the rear of at least the sign component pieces having no sign-forming markings or sign-facing markings thereon resulting in an orientation ambiguity.

2. The changeable display sign of claim 1 in which the rear side of each said sign component piece has a given color and given luster, and said orientation indicating indicia has a color substantially similar to said given color and a luster substantially different from said given luster.

3. The changeable display sign of claim 2 in which said given color is dark.

4. The changeable display sign of claim 2 in which said given luster is flat and said indicia luster is glossy.

5. The changeable display sign of claim 1 in which said orientation indicia includes arrowheads printed on the rear side of each sign component piece.

6. The changeable display sign of claim 1 in which all of said sign component pieces carry said indicia.

7. In a changeable display sign comprising: a support wall for changeable sign components, said support wall having on at least one side thereof an initially exposed sign component-receiving surface; said sign component-receiving surface having removably attached thereto a plurality of thin, flat, rectangular, flexible sign component pieces arranged in close contiguous rows so as to fill an entire sign-forming area of the sign and so that the sign component pieces from a distance appear to form a single sheet sign having one continuous flat surface, each sign component piece having a width less than that of a single row having on two adjacent sides of the piece beveled edges of a given inclination and the other two adjacent sides of the piece having edges oppositely beveled so that adjacent confronting edges of adjacent component pieces above, below and to said side thereof interfit, any sign component piece having the width of a single row having top and bottom edges with the same beveled edges as the top and bottom edges of said sign component pieces having a width less than the length of a row, whereby adjacent edges of the inner fitting sign component pieces have complementary interfitting beveled edges, the improvement wherein there is provided arrowhead-like orientation indicating indicia on the rear of at least the sign component pieces having no sign-forming markings or sign-facing markings thereon resulting in an orientation ambiguity, the rear side of each said sign component piece has a given color and given luster, and said orientation indicating indicia has a color substantially similar to said given color and a luster substantially different from said given luster.

8. The changeable display sign of claim 7 wherein said given color is dark.

9. The changeable display sign of claim 7 wherein said given luster is flat and said indicia luster is glossy.

* * * * *